US010040659B1

(12) United States Patent
Merminod

(10) Patent No.: US 10,040,659 B1
(45) Date of Patent: Aug. 7, 2018

(54) VINYL ROLL DISPENSING AND STORAGE APPARATUS

(71) Applicant: Jean-Phillippe Merminod, Tampa, FL (US)

(72) Inventor: Jean-Phillippe Merminod, Tampa, FL (US)

( * ) Notice: Subject to any disclaimer, the term of this patent is extended or adjusted under 35 U.S.C. 154(b) by 307 days.

(21) Appl. No.: 15/049,541

(22) Filed: Feb. 22, 2016

(51) Int. Cl.
*B65H 16/02* (2006.01)
*B65H 16/04* (2006.01)

(52) U.S. Cl.
CPC ..... *B65H 16/021* (2013.01); *B65H 16/04* (2013.01); *B65H 2402/42* (2013.01); *B65H 2701/19* (2013.01)

(58) Field of Classification Search
CPC .... B65H 16/021; B65H 16/04; B65H 75/265; B65H 75/403; B65H 75/4471; B65H 2402/42; B65H 2701/19; B65H 2701/3915; B65H 49/28; B65H 49/38
See application file for complete search history.

(56) References Cited

U.S. PATENT DOCUMENTS 548,987 A * 10/1895 Heyman ..... A47K 10/38 242/594
1,053,159 A * 2/1913 Crush ..... B65H 49/32 242/591
1,259,007 A * 3/1918 Fifield ..... B65H 23/08 242/422.5
3,937,414 A * 2/1976 Bank ..... B65H 49/28 242/129
5,042,737 A * 8/1991 Sigle ..... B65H 49/32 242/129
7,350,741 B1 * 4/2008 Rosa ..... B65H 75/265 242/403
2005/0150991 A1 * 7/2005 Priefert ..... B62B 1/26 242/557
2005/0236511 A1 * 10/2005 Martin ..... B65H 16/021 242/557

* cited by examiner

*Primary Examiner* — William A. Rivera
(74) *Attorney, Agent, or Firm* — Gulf Coast Intellectual Property Group

(57) ABSTRACT

A rolled material storage apparatus configured to receive a plurality of rolls of material and further provide improved loading and unloading thereof. The rolled material storage apparatus includes a frame having a first row of receiving platforms and second row of receiving platforms superposed thereto and further being parallel. A first support rod and a second support rod are coupled to the first row of receiving platforms and a second row of receiving platforms respectively. The receiving platforms are tiltably movable intermediate a first position and a second position. Secured to the receiving platforms is a mounting post configured to engage a portion of a roll of material. A locking member is present on each receiving platform and is operable to lock each platform into its first position. The frame includes wheels and a push member is further included to assist in moving the rolled material storage apparatus.

20 Claims, 3 Drawing Sheets

VINYL ROLL DISPENSING AND STORAGE APPARATUS

FIELD OF THE INVENTION

The present invention relates generally to rolled material storage apparatus, more specifically but not by limitation a rolled vinyl storage apparatus that is operable to receive and store a plurality of vinyl rolls wherein the apparatus is configured to store vinyl rolls in a dual linear configuration.

BACKGROUND

Vinyl is a common material that is utilized in a variety of different products. As is known in the art one embodiment of vinyl is the vinyl roll. Vinyl rolls are produced in a variety of sizes and colors and are utilized in various industries such as but not limited to sign production. In the sign production industry it is common to utilize large vinyl rolls wherein the most common configuration for the vinyl rolls is to have the vinyl rolls mounted in a horizontal manner on a rack or similar structure that is mounted to a wall. Users simply unroll the amount of vinyl needed for a particular task and cut the desired vinyl away from the roll.

One problem with conventional storage of vinyl rolls is the amount of room that is required to store the rolls of vinyl. As mentioned, many conventional techniques of storing vinyl rolls involve cumbersome and large structures that are typically secured to or placed adjacent to a wall. The aforementioned structures are typically not mobile and as such can not be moved proximate to a desired area where it may be more convenient to have the vinyl rolls located. Other types of storage apparatus exist for vinyl rolls exist that are mobile but have proven limited in their usefulness. Additionally, existing devices are not configured to provide a user improved access and selection of a vinyl roll stored thereon.

Accordingly, there is a need for a rolled vinyl roll storage apparatus that is configured to be mobile and further configured to provide a dual linear mounting technique for a plurality of vinyl rolls.

SUMMARY OF THE INVENTION

It is the object of the present invention to provide a rolled vinyl storage apparatus that is configured to receive and store a plurality of vinyl rolls that includes a base frame operable to facilitate transportation thereof.

Another object of the present invention is to provide a rolled vinyl storage apparatus that is configured to provide a mobile platform to store a plurality of vinyl rolls wherein the base frame includes a first end member and a second end member.

A further object of the present invention is to provide a rolled material storage apparatus that is mobile that includes a first support rod and a second support rod operably coupled intermediate the first end member and second end member and further being on opposing sides of the base frame.

Still another object of the present invention is to provide a rolled vinyl storage apparatus that further includes a first row of receiving platforms wherein the first row of receiving platforms are superposed a first side of the base frame and operably coupled to the first support rod and wherein each receiving platform is movably secured to the first support rod.

An additional object of the present invention is to provide a rolled vinyl storage apparatus that further includes a second row of receiving platforms, opposedly mounted to the first row of receiving platforms, wherein the second row of receiving platforms are superposed the second side of the base frame and movably coupled to the second support rod.

Yet a further object of the present invention is to provide a rolled vinyl storage apparatus wherein the receiving platforms of the first row and second row of receiving platforms are configured to tiltably move in opposing directions.

Another object of the present invention is to provide a rolled vinyl storage apparatus that further includes a plurality of locking members operably coupled to each receiving platform of the first row and second row of receiving platforms.

An alternate object of the present invention is to provide a rolled vinyl storage apparatus that is configured to provide mobile storage of a plurality of vinyl rolls wherein each receiving member has a post member extending upward therefrom.

Still a further object of the present invention is to provide a rolled material storage apparatus configured to store and transport a plurality of rolls of material that further includes a push member arcuate in shape and extending intermediate the first end and second end of the base frame.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
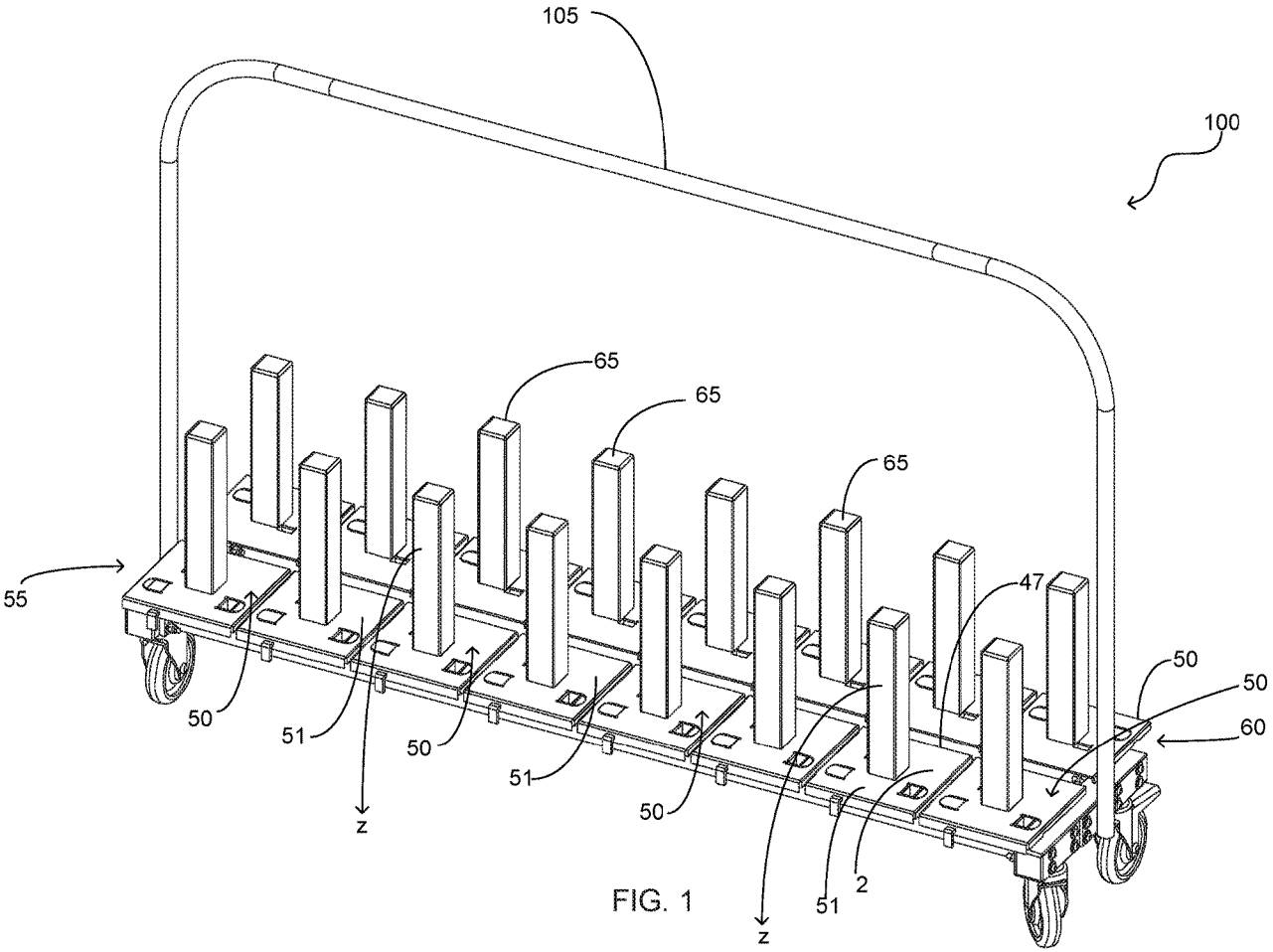
FIG. 1 is a perspective view of the present invention.
Figure 2:
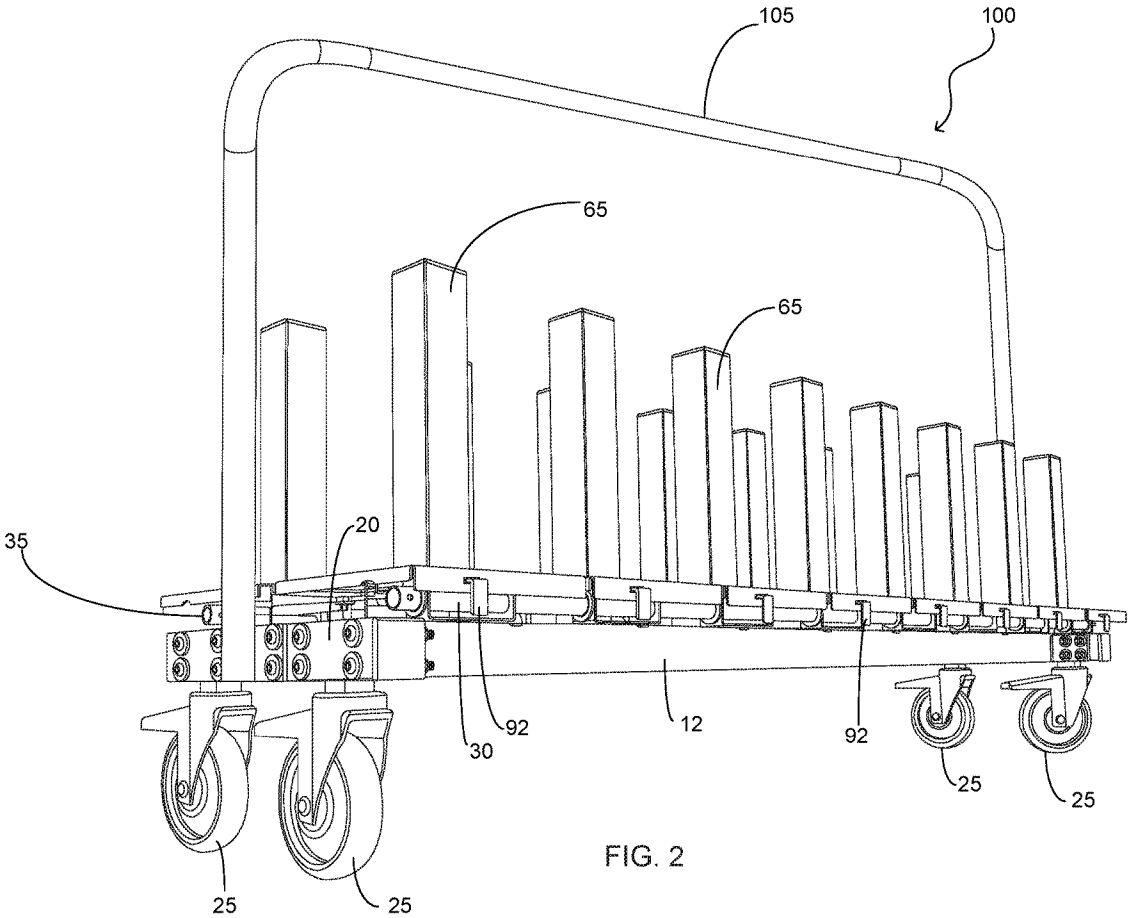
FIG. 2 is a side view of the present invention.

Referring now to the drawings submitted herewith, wherein various elements depicted therein are not necessarily drawn to scale and wherein through the views and figures like elements are referenced with identical reference numerals, there is illustrated a rolled vinyl storage apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 3:
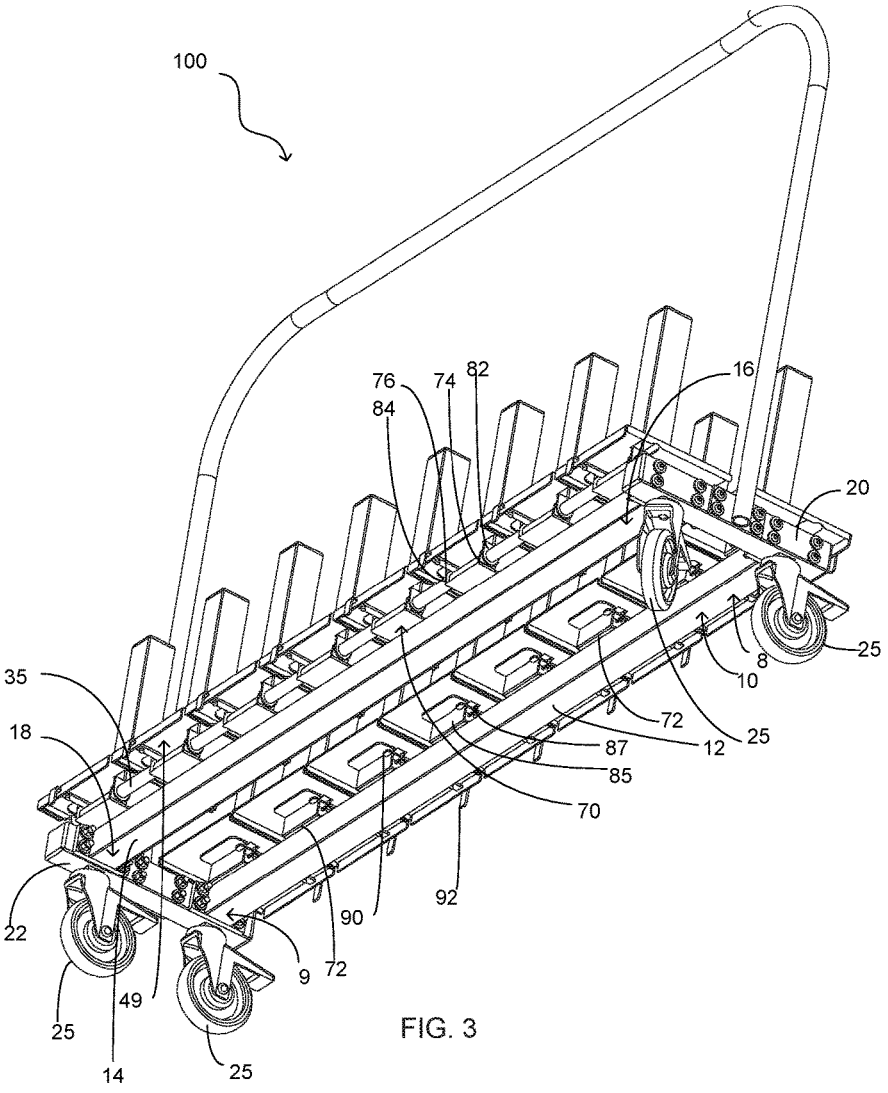
FIG. 3 is a bottom perspective view of the present invention.

Referring in particular to FIGS. 1 and 3, the rolled vinyl storage apparatus 100 includes a frame 10 that is operable to provide structured support for the rolled vinyl storage apparatus 100. The frame 10 includes a first longitudinal support member 12 and a second longitudinal support member 14 that extend substantially the length of the rolled vinyl storage apparatus 100. The first longitudinal support member 12 includes first end 8 and second end 9. The second longitudinal support member 14 includes first end 16 and second end 18. The first longitudinal support member 12 and second longitudinal support member 14 are manufactured from a suitable rigid material such as but not limited to square metal tubing. Secured to the first ends 8, 16 is the first base frame end member 20. The first base frame end member 20 is perpendicular with respect to the first longitudinal support member 12 and the second longitudinal support member 14. The second base frame end member 22 is opposite the first base frame end member 20 and is similarly constructed of metal or other durable material. The frame 10 includes a plurality of wheels 25 that are secured utilizing suitable durable techniques to the first base frame end member 20 and second base frame end member 22. The wheels 25 are conventional wheels and it is contemplated within the scope of the present invention that the frame 10 could be configured to be movable utilizing various quantities of wheels 25 or alternate elements that allow a user to move the rolled vinyl storage apparatus 100.

Extending intermediate the first base frame end member 20 and second base frame end member 22 are the first support rod 30 and second support rod 35. The first support rod 30 is adjacent the first longitudinal support member 12 and is mounted such that it is immediately above the first longitudinal support member 12 and additionally laterally outward therefrom. The first support rod 30 is mounted to the frame 10 utilizing suitable durable techniques. The second support rod 35 is mounted adjacent the second longitudinal support member 14 similarly to that as described for the first support rod 30. The first support rod 30 and second support rod 35 are manufactured from a durable rigid material such as but not limited to metal tubing. The first support rod 30 and second support rod 35 provide a mount for the receiving platforms 50 as further described herein.

The rolled vinyl storage apparatus 100 includes a plurality of receiving platforms 50. The receiving platforms 50 are organized into a first row 55 and second row 60 wherein the first row 55 and second row 60 are adjacent to each other and are superposed frame 10. The receiving platforms 50 are generally square in shape having an upper surface 51 that is of suitable size to accommodate a rolled material thereon. While the receiving platforms 50 in their preferred embodiment are square in shape, it is contemplated within the scope of the present invention that the receiving platforms 50 could be formed in various different shapes. Secured to the upper surface 51 of the receiving platform 50 is mounting post 65. Mounting post 65 is manufactured from a suitable durable material such as but not limited to metal and is secured to the receiving platform 50 using suitable techniques such as but not limited to welding. It is contemplated within the scope of the present invention that the mounting post 65 while illustrated herein as being constructed from square metal tubing could be provided in alternative shapes such as but not limited to cylindrical.

The receiving platforms 50 further include a mounting member 70 integrally formed with the bottom surface 49 and extending downward therefrom. The mounting member 70 is configured to secure the receiving platform 50 to the first support rod 30 and second support rod 35. The mounting member 70 includes base plate 72 that is secured to the first longitudinal support member 12 for the first row 55 and the second longitudinal support member 14 for the second row 60. The base plate 72 is manufactured from a suitable durable material such as but not limited to metal and is secured utilizing suitable techniques such as but not limited to welding. Extending upward from opposing sides of the base plate 72 are the first mounting ring 74 and second mounting ring 76. The first mounting ring 74 and second mounting ring 76 are perpendicular to the base plate 72 and are configured to receive the first support rod 30 and second support rod 35 therethrough. The first mounting ring 74 and second mounting ring 76 are configured to facilitate rotatable movement of the receiving platform 50 with respect to the first support rod 30 and/or the second support rod 35 as further discussed herein. Adjacent to the first mounting ring 74 and second mounting ring 76 are the first mounting tab 82 and second mounting tab 84. The first mounting tab 82 and second mounting tab 84 are secured to the bottom surface 49 of the receiving platform 50 and extend perpendicularly downward therefrom. The first mounting tab 82 and second mounting tab 84 are axially aligned with the first mounting ring 74 and second mounting ring 76 allowing the first support rod 30 and/or the second support rod 35 to journal therethrough. The receiving platform 50 is tiltably movable intermediate a first position and a second position. Shown in FIG. 1 herein, directional axis Z indicates the movement facilitated by the aforementioned mounting configuration provided by the mounting member 70. The receiving platform 50 is hinged outward along directional axis Z when a user needs to load or unload a roll of material from the receiving platform 50. FIG. 1 illustrates the receiving platforms 50 in their first position wherein the receiving platforms 50 are horizontal. Directional axis Z indicates the direction of movement to the second position of the receiving platforms 50 wherein the inner edge 47 moves upward and outward such that the upper surface 51 is angular with respect to the frame 10 providing an improved technique of loading a roll of material onto the mounting post 65.

Subsequent the roll of material being loaded onto the mounting post 65, the receiving platform 50 is moved back to its first position shown in FIG. 1. While specific elements have been illustrated and discussed herein facilitating the rotatable movement of the receiving platform 50 around the first support rod 30 and second support rod 35, it is contemplated within the scope of the present invention that the receiving platforms 50 could be mounted to the frame 10 in alternate manners so as to facilitate the movement intermediate the first position and second position as described herein.

Integrally secured to base plate 72 is rear plate 85. Rear plate 85 extends perpendicularly upward from base plate 72 and includes an aperture journaled therethrough that is configured to receiving locking bar member 90. Extending downward from the bottom surface 49 is locking tab 87 that includes an aperture therethrough configured to receive locking bar member 90 therethrough. When the receiving platform 50 is in its first position, the rear plate 85 and locking tab 87 are aligned so as to permit the locking bar member 90 to be journaled through the aforementioned apertures and inhibit the receiving platform 50 from being moved accidentally to its second position. The locking bar member 90 includes tab 92 integrally formed therewith. Tab 90 provides an interface for a user to slidably move the locking bar member 90 so as to either lock the receiving platform 50 into its first position wherein the locking bar member 90 is journaled through the apertures of the locking tab 87 and rear plate 85. Alternatively, disengaging the locking bar member 90 from the rear plate 85 and locking tab 87 permits the receiving platform 50 to be moved to its second position as described herein. While specific elements have been illustrated and discussed herein facilitating the locking/unlocking of the receiving platform 50, it is contemplated within the scope of the present invention that alternate elements could be utilized to provide the desired functionality of locking/unlocking the receiving platform 50.

The rolled vinyl storage apparatus 100 further includes push member 105. Push member 105 is configured to allow a user to move the rolled vinyl storage apparatus 100 by providing a technique to engage therewith. The push member 105 extends the length of the frame 10 and is elevated so as to provide an effective technique to engage the rolled vinyl storage apparatus 100. The push member 105 is manufactured from a suitable durable material such as but not limited to metal tubing. While a specific configuration of the push member 105 is illustrated herein, it is contemplated within the scope of the present invention that the rolled vinyl storage apparatus 100 could be configured with alternate elements to facilitate the ability of a user to move the rolled vinyl storage apparatus 100.

While a first row 55 and second row 60 having a plurality of receiving platforms 50 have been illustrated and discussed herein, it is contemplated within the scope of the present invention that the frame 10 could be configured to have as few as two receiving platforms 50 opposedly mounted and configured to move intermediate their first position and second position as described herein. Additionally, it should be recognized that the first row 55 and second row could be configured to have various quantities of receiving platforms 50.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A rolled material storage apparatus configured to receive and store at least two rolls of material comprising:

a frame; said frame being rectangular in shape, said frame having a first end and a second end, said frame having a first side and a second side;

a first support rod, said first support rod being mounted adjacent said first side of said frame, said first support rod extending the length of said frame;

a second support rod, said second support rod being mounted proximate said second side of said frame, said second support rod extending the length of said frame;

at least two receiving platforms, said at least two receiving platforms being superposed said frame, said at least two receiving platforms having an upper surface and a lower surface, said at least two receiving platforms being operably coupled to said first support rod and said second support rod, said at least two receiving platforms being mounted on opposing sides of said frame, said at least two receiving platforms being movably intermediate a first position and a second position; and wherein in said first position said at least two receiving platforms are horizontal in orientation so as to maintain a roll of material disposed thereon in an upright position.

2. The rolled material storage apparatus as recited in claim 1, and further including at least two mounting posts, said at least two mounting post being centrally secured to each of said at least two receiving platforms extending upward therefrom, said at least two mounting posts configured to engage a portion of a roll of material.

3. The rolled material storage apparatus as recited in claim 2, and further including a mounting member, said mounting member being secured to the frame, said mounting member facilitating the coupling of the at least two receiving platforms to said first support rod and said second support rod.

4. The rolled material storage apparatus as recited in claim 3, wherein in said second position said at least two receiving platforms are tiltably moved outward with respect to said frame so as to position the mounting member at an angle for receipt of a roll of material.

5. The rolled material storage apparatus as recited in claim 4, and further including a locking member, said locking member operable to lock said at least two receiving platforms in said first position.

6. The rolled material storage apparatus as recited in claim 5, wherein said mounting member further a rear plate member, said rear plate member configured to engage said locking member.

7. The rolled material storage apparatus as recited in claim 6, and further including a push member, said push member being coupled to said frame, said push member providing an interface to engage and move the rolled material storage apparatus.

8. A rolled material storage apparatus that is configured to receive and store a plurality of rolls of material and is further configured to facilitate the movement thereof comprising:

a frame; said frame being rectangular in shape, said frame having a first end and a second end, said frame having a first side and a second side;

a first support rod, said first support rod being mounted adjacent said first side of said frame, said first support rod extending the length of said frame;

a second support rod, said second support rod being mounted proximate said second side of said frame, said second support rod extending the length of said frame;

a first row of receiving platforms, said first row of receiving platforms being superposed said frame proximate said first side thereof, said first row of receiving platforms comprising a plurality of adjacent receiving platforms, said plurality of receiving platforms having an upper surface and a lower surface, said first row of receiving platforms being operably coupled to said first support rod, said first row of receiving platforms being movably intermediate a first position and a second position;

a second row of receiving platforms, said second row of receiving platforms being superposed said frame proximate said second side thereof, said second row of receiving platforms comprising a plurality of adjacent receiving platforms, said plurality of receiving platforms having an upper surface and a lower surface, said second row of receiving platforms being operably coupled to said second support rod, said second row of receiving platforms being movably intermediate a first position and a second position; and wherein in said first position said plurality of receiving platforms of said first row of receiving platforms and said second row of said receiving platforms being horizontal in orientation in said first position so as to maintain a roll of material disposed thereon in an upright position.

9. The rolled material storage apparatus as recited in claim 8, and further including a plurality of mounting members, said plurality of mounting members being superposed said frame, said plurality of mounting members being underneath said plurality of receiving platforms of said first row of receiving platforms and said second row of receiving platforms, said plurality of mounting members configured to couple said first row of said receiving platforms to said first support rod and couple said second row of receiving platforms to said second support rod.

10. The rolled material storage apparatus as recited in claim 9, and further including a plurality of mounting posts, said plurality of mounting posts being secured to each of said plurality of receiving platforms of said first row of receiving platforms and said second row of receiving platforms, said plurality of mounting posts extending upward from said plurality of receiving platforms so as to engage a portion of a roll of material.

11. The rolled material storage apparatus as recited in claim 10, wherein in said second position, said plurality of receiving platforms of said first row of receiving platforms and said second row of receiving platforms are tilted at an angle so as to facilitate the loading and unloading of a roll of material onto the mounting posts.

12. The rolled material storage apparatus as recited in claim 11, wherein said plurality of mounting members further include a first mounting ring and a second mounting ring, said first mounting ring and said second mounting ring operably coupled with said first support rod and said second support rod.

13. The rolled material storage apparatus as recited in claim 12, and further including a plurality of locking members, said plurality of locking members being operably coupled with each of said plurality of receiving platforms of said first row of receiving platforms and said second row of receiving platforms, said plurality of locking members operable to lock said plurality of receiving platforms in said first position.

14. The rolled material storage apparatus as recited in claim 13, wherein said plurality of mounting members further include a rear plate member, said rear plate member configured to engage said plurality of locking members.

15. A rolled material storage apparatus configured to receive and store a plurality of rolls of material and facilitate the improved loading and unloading of the rolls of material comprising:

a frame; said frame being rectangular in shape, said frame having a first end and a second end, said frame having a first side and a second side;

a first support rod, said first support rod being mounted adjacent said first side of said frame, said first support rod extending the length of said frame;

a second support rod, said second support rod being mounted proximate said second side of said frame, said second support rod extending the length of said frame;

a first row of receiving platforms, said first row of receiving platforms being superposed said frame proximate said first side thereof, said first row of receiving platforms comprising a plurality of adjacent receiving platforms, said plurality of receiving platforms having an upper surface and a lower surface, said first row of receiving platforms being operably coupled to said first support rod, said first row of receiving platforms being movably intermediate a first position and a second position;

a second row of receiving platforms, said second row of receiving platforms being superposed said frame proximate said second side thereof, said second row of receiving platforms comprising a plurality of adjacent receiving platforms, said plurality of receiving platforms having an upper surface and a lower surface, said second row of receiving platforms being operably coupled to said second support rod, said second row of receiving platforms being movably intermediate a first position and a second position;

a plurality of mounting members, said plurality of mounting members being superposed said frame, said plurality of mounting members being underneath said plurality of receiving platforms of said first row of receiving platforms and said second row of receiving platforms, said plurality of mounting members configured to couple said first row of said receiving platforms to said first support rod and couple said second row of receiving platforms to said second support rod, said plurality of mounting members including a base plate, said plurality of mounting members further including a rear plate, said rear plate being perpendicular to said base plate and secured thereto, said plurality of mounting members further including a first mounting ring and a second mounting ring extending upward from said base plate, said first mounting ring and said second mounting ring being secured to opposing sides of said base plate, said first mounting ring and said second mounting ring operable to couple with said first support rod and said second support rod;

wherein in said first position said plurality of receiving platforms of said first row of receiving platforms and said second row of said receiving platforms being horizontal in orientation in said first position so as to maintain a roll of material disposed thereon in an upright position.

16. The rolled material storage apparatus as recited in claim 15, wherein each of said plurality of receiving platforms includes a first mounting tab and a second mounting tab, said first mounting tab and said second mounting tab being secured to the bottom surface of said plurality of receiving platforms and extending downward therefrom, said first mounting tab and said second mounting tab being in alignment with said first mounting ring and said second mounting ring so as to receive the first support rod and the second support rod therethrough.

17. The rolled material storage apparatus as recited in claim 16, and further including a plurality of locking tabs, said plurality of locking tabs being formed with the bottom surface of each of said plurality of receiving platforms and extending downward therefrom.

18. The rolled material storage apparatus as recited in claim 17, and further including a plurality of locking members, said plurality of locking members being operably coupled with each of said plurality of receiving platforms of said first row of receiving platforms and said second row of receiving platforms, said plurality of locking members operable engage the plurality of locking tabs and said rear plates of said plurality of mounting members so to lock said plurality of receiving platforms in said first position.

19. The rolled material storage apparatus as recited in claim 18, wherein in said second position, said plurality of receiving platforms of said first row of receiving platforms and said second row of receiving platforms are tilted at an angle so as to facilitate the loading and unloading of a roll of material onto the plurality of mounting posts.

20. The rolled material storage apparatus as recited in claim 19, and further including a push member, said push member being coupled to said frame, said push member providing an interface to engage and move the rolled material storage apparatus.

* * * * *